US007717811B1

(12) United States Patent
Merullo

(10) Patent No.: US 7,717,811 B1
(45) Date of Patent: May 18, 2010

(54) ADJUSTABLE GOLF TEE WITH ASSOCIATED MEASURING DEVICE

(76) Inventor: Michael Joseph Merullo, 1960 Cambridge Blvd., Columbus, OH (US) 43221

( * ) Notice: Subject to any disclaimer, the term of this patent is extended or adjusted under 35 U.S.C. 154(b) by 113 days.

(21) Appl. No.: 11/975,436

(22) Filed: Oct. 19, 2007

Related U.S. Application Data

(60) Provisional application No. 60/862,851, filed on Oct. 25, 2006.

(51) Int. Cl.
*A63B 57/00* (2006.01)

(52) U.S. Cl. ..... 473/387; 473/400

(58) Field of Classification Search ..... 473/387–403; D21/717, 718
See application file for complete search history.

(56) References Cited

U.S. PATENT DOCUMENTS

| | | | | |
|---|---|---|---|---|
| 230,585 | A | 7/1880 | Soule | |
| 1,584,832 | A | 5/1926 | Benneke | |
| 1,597,740 | A * | 8/1926 | Thompson | 473/394 |
| D174,910 | S | 6/1955 | Larson | |
| 2,839,304 | A | 6/1958 | Lerick | |
| 3,114,557 | A | 12/1963 | Cabot | |
| 3,203,700 | A | 8/1965 | Antonious | |
| 3,408,079 | A | 10/1968 | Kirikos | |
| 5,356,146 | A | 10/1994 | Blosser | |
| D370,041 | S * | 5/1996 | Thomas | D21/718 |
| 5,672,122 | A | 9/1997 | Strong | |
| 5,890,976 | A * | 4/1999 | Anderson | 473/398 |
| D413,640 | S * | 9/1999 | Fearer, III | D21/718 |
| 6,053,821 | A | 4/2000 | Palmer | |
| 6,062,989 | A | 5/2000 | Wagner et al. | |
| 6,062,990 | A | 5/2000 | Pierce | |
| 6,083,121 | A | 7/2000 | Hovey | |
| 6,086,486 | A | 7/2000 | Murphy et al. | |
| 6,110,059 | A | 8/2000 | Haggarty | |
| 6,155,930 | A | 12/2000 | Madara | |
| 6,196,233 | B1 | 3/2001 | Anastasio | |
| 6,200,233 | B1 | 3/2001 | Moody | |
| 6,224,494 | B1 | 5/2001 | Patsky | |

(Continued)

FOREIGN PATENT DOCUMENTS

| | | | |
|---|---|---|---|
| GB | 2307182 | A | 5/1997 |

(Continued)

*Primary Examiner*—Steven Wong
(74) *Attorney, Agent, or Firm*—Roger A. Gilcrest

(57) ABSTRACT

The present invention is a golf tee and golf tee system, and method for its use, which system includes a golf tee adapted to allow a person to determine the desired position of a teed golf ball with respect to a desired striking position on the golf club face of a golf club striking the teed golf ball once the tee is placed, the golf tee comprising: (a) a cup portion; (b) a stake portion, the stake portion having at least one measurement scale and a guide scale, each scale having respective corresponding indicia, the measurement scale being arranged so as to allow the player to determine the desired striking position on the golf club face, and the guide scale having respective corresponding indicia so as to allow a person to determine the attachment position of a removable insertion restriction portion; and a plurality of receivers aligned along the stake portion and adapted to releasably attach the removable insertion restriction portion; and (c) a removable insertion restriction portion, adapted to be removable and to be placed on at least two positions along the length of the stake portion.

11 Claims, 3 Drawing Sheets

U.S. PATENT DOCUMENTS 6,224,500 B1 5/2001 Mizohata
6,244,464 B1 6/2001 Goserud
6,280,350 B1 8/2001 Chung
6,287,219 B1 9/2001 Addington
6,309,315 B1 10/2001 Adams et al.
6,319,156 B1 11/2001 Alexsen
6,328,663 B1 12/2001 Lipstock
6,338,685 B1 1/2002 Posluszny
6,341,752 B1 1/2002 Green
6,344,003 B1 2/2002 Choung
6,344,004 B2 2/2002 Adams et al.
6,348,008 B1 2/2002 Bertoniere, Jr.
6,394,515 B1 5/2002 Keleher et al.
6,450,895 B1 9/2002 Galluzzo, Jr.
6,454,669 B1 9/2002 James
6,458,040 B1 10/2002 Veazie, III
6,482,111 B1 11/2002 Jofferion
6,506,131 B2 1/2003 Adams et al.
6,659,882 B2 12/2003 Patsky
6,679,792 B1 1/2004 Dorfman
6,682,443 B1 1/2004 Liu
6,692,382 B2 2/2004 Adams et al.
6,698,615 B2 3/2004 Knightlinger
6,729,977 B1 5/2004 Young et al.
D492,374 S * 6/2004 Barouh ..... D21/718
6,832,964 B2 12/2004 Adams et al.
6,849,008 B1 2/2005 Wang
6,899,634 B2 5/2005 Hull et al.
6,960,143 B2 11/2005 Sato
6,997,822 B2 2/2006 Adams et al.
6,998,428 B1 2/2006 Paiement
D517,138 S * 3/2006 Barouh ..... D21/718
D517,622 S * 3/2006 Barouh ..... D21/718
7,008,335 B2 3/2006 Kim
7,016,857 B1 3/2006 Lloyd et al.
7,052,416 B2 5/2006 Chang
7,066,844 B1 6/2006 Noggle
7,094,163 B2 8/2006 Lu et al.
7,104,900 B1 9/2006 Finley
7,156,758 B2 1/2007 Lu
7,198,573 B2 4/2007 Kim
D543,597 S 5/2007 Lee et al.
7,223,184 B2 5/2007 Suwito
7,238,118 B1 7/2007 Terrill
7,238,124 B2 7/2007 Adams et al.
D572,323 S * 7/2008 Merullo ..... D21/718
7,488,263 B2 * 2/2009 Lee ..... 473/394
2002/0013186 A1 1/2002 Webb
2008/0039238 A1 2/2008 Lee
2009/0088274 A1 * 4/2009 Blais ..... 473/398

FOREIGN PATENT DOCUMENTS

JP 2004344250 A 12/2004
WO WO 2005037380 A1 4/2005

* cited by examiner

ADJUSTABLE GOLF TEE WITH ASSOCIATED MEASURING DEVICE

RELATED APPLICATION DATA

This application claims the priority benefit of U.S. Provisional Application Ser. No. 60/862,851, filed Oct. 25, 2006, which is hereby incorporated in its entirety herein by reference.

FIELD OF THE INVENTION

The present invention relates to golf equipment. More particularly, the invention pertains to a method and apparatus for aiding a golfer in vertically positioning a golf ball on a golf tee for consistent optimal striking using any one of a plurality of different golf club heads.

BACKGROUND OF THE INVENTION

For as long as the game of golf has been played, golfers have struggled to consistently drive the ball as far and straight as their talents and patience will permit. Many factors can contribute to a poorly shot golf ball. For example, a golfer's grip, stance, distribution of weight, head position, bends in the arms and legs, swinging motion, pivot, and follow-through are all examples of elements that golfers work on intently to achieve a consistent and ideal golf swing.

Another factor affecting the quality of a golf shot is the vertical point at which the face of the golf club strikes the ball. At the ideal striking point, a clubface makes initial contact with the midpoint of a golf ball at the club's "sweet spot," or a portion of the clubface designed to provide the straightest and longest drive. Initial contact with the ball above or below its center or above or below the clubface's sweet spot can result in too little or too much loft, excess spin, and generally a shorter, less accurate drive.

Conventional golf tees are used by golfers on their opening swing of each hole to elevate the golf ball above the ground and can be used to facilitate contact at the ideal striking point. Conventional golf tees are typically made of wood or plastic, have a stake portion with a pointed end for insertion into the turf, and have a cupped end for supporting a golf ball. The shaft of conventional golf tees is typically a solid color, such as white or brown.

The optimal depth for tee insertion to facilitate the ideal striking point at a club's "sweet spot" is known to be the depth that allows the bottom of the club head to rest on the turf while the top of the club head is even with the center of the golf ball. This ideal insertion depth is consistent with the following formula: DFT=CFH−(½*DGB), where DFT is the distance from the top of the tee, or the portion of tee remaining above the ground when the tee is inserted; CFH stands for clubface height; and DGB stands for diameter of golf ball.

The method of using a conventional golf tee in the ordinary course is for the golfer to insert the tee into the ground unaided by measurement or reference point. The golfer simply relies upon his/her eyesight and best judgment to insert the tee into the turf at approximately the optimal depth. Thus, each time a golfer uses a conventional golf tee under the ordinary method s/he must estimate both the clubface height (CFH) and the diameter of the golf ball (DGB) in order to calculate the correct distance from the top of the tee (DFT) in which to insert the tee.

A problem with conventional golf tees and their method of use is that the golfer must re-estimate the proper depth each time he or she inserts the tee into the turf. This can lead to inconsistent tee heights, leading to inconsistent drives. This problem has been addressed in the prior art by providing a reference point on the tee shaft, for example lines, notches or a stopping mechanism, such as a removable or non-removable horizontal member that makes contact with the ground when the tee shaft is inserted to the proper depth.

A second problem with conventional tees, and one not addressed by the prior art, is the actual method of insertion depth estimation. Thus, while markings on a tee shaft may allow a golfer to insert his/her tee at the same depth each time, this does not guarantee that the depth consistently used is the optimal one.

For example, Blosser (U.S. Pat. No. 5,356,146) teaches the use of a sequence of stripes in repeating colors on the shaft of the golf tee but fails to provide any means of assisting the golfer in selecting the correct stripe. Several other patents use removable stoppers, which are either screwed on, such as Young (U.S. Pat. No. 6,729,977), Thomas (U.S. Pat. D370,041), and Cabot (U.S. Pat. No. 3,114,557) or clipped on, such as Strong (U.S. Pat. No. 5,672,122), Antonious (U.S. Pat. No. 3,203,700), and Kirikos (U.S. Pat. No. 3,408,079). However, like Blosser, these devices similarly fail to provide a suitable means of assisting the golfer in initially ascertaining the proper insertion depth.

Trial and error presents one means of determining which of several reference points on a tee shaft a golfer may choose to use. However, this method is disadvantageous for several reasons. First, it is time consuming. Second, it must be repeated whenever a new club is used. Third, this method can lead to inconsistent results and may encourage non-ideal swings. For example, a golfer may conclude that a particular marking of the tee shaft is the favored reference point for tee insertion after hitting several good shots on the driving range. However, what the golfer may not realize is that s/he is actually adjusting his/her golf swing to accommodate a non-ideal tee depth, and is thereby reducing this ability to achieve consistency and power in the swing itself. Similarly, a golfer may have accurately estimated the ideal insertion depth but still hit a poor shot due to any one of a wide variety of unrelated problems with his/her stroke. Under the trial and error method, the golfer may be inclined to adjust the insertion depth rather than addressing the actual cause of his/her problematic swing. Thus, the trial and error method does not eliminate tee insertion depth as one of the possible causes of a poorly driven golf ball.

Another means of determining which of several reference points a golfer should use when estimating the proper depth to insert a golf tee is to survey the field of golf clubs and to prescribe a predetermined reference point for each particular club, such as suggested by Strong (U.S. Pat. No. 5,672,122). The drawback of this method is that golf club heads vary widely by manufacturer and also vary by type of club, i.e. drivers, woods, and irons. Moreover, a club head of a particular manufacturer and club type can vary with time, as new models are introduced and poor selling models are discontinued. Thus the apparatus and method taught by Strong is susceptible to becoming out of date and therefore irrelevant.

In light of the drawbacks of the apparatus and methods of the prior art, a new device and method are needed to aid the golfer in consistently inserting the tee to ideal depths.

SUMMARY OF THE INVENTION

The embodiments of the method and apparatus described herein address the shortcomings of the prior art by incorporating a measuring system that works in concert with reference points on a golf tee to consistently and accurately aid the golfer in inserting a golf tee.

Generally, a golf tee may comprise a pointed end suitable for insertion into the ground, a second end suitable for supporting a golf ball, and a shaft connecting the pointed end and supporting end and having a surface suitable for imprinting markings. The golf tee could be made of any substantially rigid, durable, and cost effective material such as but not limited to wood, plastic, metal, or rubber. The ball-supporting end could be cup shaped, could utilize a plurality of supporting prongs, or could take any other form capable of supporting a golf ball.

The shaft could be of a generally cylindrical shape, a cone shape, a parallelepiped shape having three or more sides along its length, or any other shape that is convenient to remotely connect the pointed end with the ball-supporting end while providing a surface for reference points and/or measuring points. Moreover, the shaft could be tapered out or in at one or both ends or could be tapered along its length such that the area of horizontal sections along the length of the shaft are of different dimensions.

In one embodiment, the shaft surface may comprise a plurality of evenly spaced, vertically distributed measuring points. The portion of the shaft wherein the measuring points are located could be flat in one embodiment or could be of same general shape as the rest of the shaft surface.

In another embodiment, measuring points could be provided separately from the shaft surface on any tangible medium, such as on product packaging or an additional included surface, such as a separable collar that can be removably attached onto the tee shaft.

The measuring points may consist of dots, lines, grooves, notches, or other markings. The measuring points may also be associated with identifying indicia, such as numbers, letters, colors, or other indicia.

In one embodiment, the shaft surface may comprise a plurality of evenly spaced, vertically distributed reference points. The reference points may consist of dots, lines, grooves, notches, or other markings. The measuring points may also be associated with identifying indicia, such as numbers, letters colors, or other indicia.

In one embodiment, the identifying indicia for the reference points may relate to the identifying indicia of the measuring points. For example, if numbers 1 through 14 are used as identifying indicia of the measuring points, a set of numbers 1 through 14 would mark the reference points corresponding with these measuring points.

In one embodiment, the reference points could be vertically positioned on the tee shaft such that each reference point identifies an insertion depth of the golf tee to optimally facilitate the ideal striking point for a particularly sized golf club head.

In one embodiment, the distance between the ball-supporting end of the golf tee and a reference point is substantially equal to the distance from the ball-supporting end to a measuring point having corresponding indicia minus a fixed distance substantially equal to a fixed percentage of a standard golf ball diameter. Thus, in an embodiment wherein both the measuring and reference points are integrally included on the tee shaft, each reference point will be vertically positioned higher on the tee shaft than its corresponding measuring point by a fixed distance.

For example, in one embodiment, the fixed percentage of the golf ball diameter could be 50%, or the radius of the golf ball. If greater or lower loft of the resulting drive is desired, an embodiment could utilize a different percentage for the fixed percentage. For example, if greater loft is desired, a fixed percentage of less than 50% of golf ball diameter could be utilized to achieve a higher ball elevation. Similarly, if lower loft is desired, a fixed percentage of greater than 50% of golf ball diameter could be utilized to achieve a lower ball elevation.

The assumed standard sized diameter for a golf ball could be the 2006 PGA regulation minimum 42.67 mm in one embodiment. In other embodiments the assumed standard sized diameter for a golf ball could be any larger size, such as but not limited to about 43 mm or any smaller size, such as but not limited to about 42 mm.

In one embodiment the reference points can be formed by fully circumferential or partially circumferential grooves formed into the shaft, having upper and lower walls and capable of receiving a separable collar. In another embodiment wherein the shaft has flat surfaces along its length, for example a parallelepiped having three or more such sides, the grooves could be formed into one or more sides.

In one embodiment, the collar could be a generally flat, semi-rigid/semi-flexible, disk-like element including a central opening and an opening throat leading into the opening, the smallest dimension of the opening being slightly smaller than the width of the groove such that the collar flexes when pushed into the groove and snaps into place when the central opening makes contact with the groove and is held in place by the upper and lower walls of the groove.

In other embodiments, the separable collar could be a non-disk-like shape, for example rectangular, triangular, or any other shape. In other embodiments, the insertion restricting portion my be a pin or similar object that may be releasably attached to the stake portion of the tee, such as being placed in holes placed in similar fashion to grooves.

In another embodiment the collar could be formed with a notch at one or both of the inside edges of the opening throat such that the inserted collar snaps into place around one or more edges of a shaft having flat surfaces along its length.

The collar could be made of any semi-rigid/semi-flexible, durable, and cost effective material such as but not limited to wood, plastic, metal, or rubber. In one embodiment, the separable collar could have at least one surface capable of being imprinted with words, designs, pictures, or colors. Thus, the separable collar surface could be customized to contain advertising, logos, or other content.

A method of using the aforementioned golf tee can include placing the bottom of the measuring surface even with the bottom of a club head and orientating the measuring surface substantially parallel with the face of the golf club head. A golfer can determine the measuring point that most closely aligns with the top edge of the club head face. Taking the identifying indicia of the particular measuring line closest to the top edge of the clubface, the golfer can then locate a reference point on the shaft of the golf tee labeled with corresponding indicia and positioned such that the distance from the top of the golf tee is substantially equal to the difference between the club face height and the ideal percentage of the standard golf ball diameter.

In one embodiment, the golfer then inserts the separable collar into the identified reference point groove until the collar is securely attached to the shaft. Alternatively, in an embodiment not including grooves as reference points, the golfer can attach the separable collar onto the tee shaft at the identified horizontal reference point.

Next, the golfer can insert the pointed end of the golf tee into the turf until the collar makes contact with the turf. Alternatively, in an embodiment not including a separable collar, the golfer can simply insert the golf tee into the ground until the reference point is level with the turf.

In another embodiment, a golfer could determine a desired reference point through the method of holding the golf tee next to the club such that the ball-supporting end is parallel with the top of the clubface, and simply identifying the reference point on the golf tee that aligns with the bottom of the club head. This reference point represents a tee height in which 100% of the ball diameter will be located above the club head when the club rests on the turf.

In another embodiment, the separable collar could be used as a ball marker.

In general terms, the invention may be described as including the following:

Golf Tee with Insertion-Restricting Piece

The invention includes a golf tee adapted to allow a person to determine the desired position of a teed golf ball with respect to a desired striking position on the golf club face of a golf club striking the teed golf ball once the tee is placed, the golf tee comprising: (a) a cup portion; (b) a stake portion, the stake portion having at least one measurement scale and a guide scale, each scale having respective corresponding indicia, the measurement scale, being arranged so as to allow the player to determine the desired striking position on the golf club face, and the guide scale having respective corresponding indicia so as to allow a person to determine the attachment position of a removable insertion restriction portion; and a plurality of receivers aligned along the stake portion and adapted to releasably attach the removable insertion restriction portion; and (c) a removable insertion restriction portion, adapted to be removable and to be placed on at least two positions along the length of the stake portion.

It is preferred that the measurement scale(s) and the guide scale each have respective corresponding indicia in a series, the series of the measurement scale(s) and of the guide scale are positioned so as to allow the user to determine the depth of the insertion of the golf tee required to hold a golf ball thereupon at a predetermined height above the ground, and to guide the placement of the insertion restriction portion along the stake portion so as to prevent the golf tee being inserted beyond the depth. It is most preferred that the measurement scale(s) and the guide scale each having respective corresponding indicia in a series, wherein the series of the measurement scale(s) and of the guide scale progress in opposite directions along the stake portion.

As an alternative embodiment, the cup portion may be substituted with any appropriate structure to accommodate any size or shape of an object to be supported in preparation for striking, such as an oblong shape, etc. In cases involving teed objects of non-spherical shapes, it will be appreciated that the scale differential between the measurement scale(s) and guide scale may be adjusted (or variations in the correspondence made logically by the user) to adapt the present invention for the support of non-spherical shapes and the site of intended impact along the club face's vertical dimension.

The golf tee measurement scale(s) and guide scale may use any indicia capable of allowing the user to discern the desired height of the intended striking portion of the club face, so long as the measurement scale(s) and guide scale can be logically connected by the user. Naturally, it will be preferred that the indicia used on both measurement scale(s) and guide scale are corresponding symbols, such as numerals or letters, to identify the different positions along the stake portion.

The measurement scale(s) may bear any logical algorithmic relationship to the guide scale based upon a measurement taken from the club face, so as to allow the user to determine the vertical height of the sweet spot. For instance, other variations may contain a scale that allows the user to measure the approximate height of the vertical sweet spot itself, and to have this information translated to guide indicia to guide placement of the insertion restricting portion, such as a disk. This may be valuable in cases where a given club has a sweet spot designed into the club by the manufacturer to be centered about a point that is either lower or higher than the vertical center. One such alternative scale may be one that directly allows the user to measure the club face directly to determine the approximate point on the measurement scale of the judged or known sweet spot. The guide scale may then be provided to be logically or algorithmically related to this measurement in a similar fashion as in the preferred embodiment.

The golf tee may optionally have a stake portion having at least two measurement scales, each measurement scale has corresponding indicia at different positions along the stake portion.

The multiple measurement scales may be distinguished by identifying indicia or color.

In another variation of the present invention, the system of the present invention may use a measurement scale on a thing separate from the tee itself, such as on a separate ruler device against which the club's face can be measured to determine the correct indicia to be used on the guide scale of the tee. Such a ruler may also have multiple measurement scales as described herein.

Golf Tee

The invention also includes a golf tee adapted to allow a person to determine the desired position of a teed golf ball with respect to a desired striking position on the golf club face of a golf club striking the teed golf ball once the tee is placed, and to releasably receive an insertion restriction portion, the golf tee comprising: (a) a cup portion; and (b) a stake portion, the stake portion having at least one measurement scale and a guide scale, each scale having respective corresponding indicia, the measurement scale being arranged so as to allow the player to determine the desired striking position on the golf club face, and the guide scale having respective corresponding indicia so as to allow a person to determine the attachment position of a removable insertion restriction portion; and a plurality of receivers aligned along the stake portion and adapted to releasably attach the removable insertion restriction portion, as described herein.

The present invention also includes a golf tee adapted to allow a person to determine the desired position of a teed golf ball with respect to a desired striking position on the golf club face of a golf club striking the teed golf ball once the tee is placed, and to releasably receive an insertion restriction portion, the golf tee comprising: (a) a cup portion; and (b) a stake portion, the stake portion having at least one measurement scale and a guide scale, each scale having respective corresponding indicia, the scales increasing in magnitude in opposite directions along the stake portion, so as to allow a person to determine the attachment position of a removable insertion restriction portion; and a plurality of receivers aligned along the stake portion and adapted to releasably attach the removable insertion restriction portion.

In general terms that present invention also comprises a golf tee comprising at least two different scales which cooperate to allow one to determine the height of the object, such as a ball, once placed upon the tee from any comparison to or alignment with the club face to be used to strike the object/ball, and to allow one to determine the proper insertion depth of the tee to arrive at that desired height, in order to guide the positioning of a depth-restriction portion of the tee.

Method of Determining the Proper Depth of Insertion for a Golf Tee

The present invention also includes a method of determining the proper depth of insertion for a golf tee as described herein.

The method of the present invention also includes first determining the sweet spot through a measurement of the club face, and translating that measurement to a guide indication to guide the placement of the insertion-restricting portion.

The method of the present invention in general terms includes using opposing or otherwise algorithmically coordinated scales to determine the proper placement of an insertion restricting device on a golf tee, which in turn allows for the insertion and placement of the golf tee at the height most appropriate of desirable for striking the ball.

As described herein, the present method may use a combination of scales to make the tee height determination with due regard for the diameter of the ball and the height of the club face.

The references referred to herein are hereby incorporated herein by reference.

DETAILED DESCRIPTION OF THE PREFERRED EMBODIMENTS

In accordance with the foregoing summary, the following describes a preferred embodiment of the present invention which is considered to be the best mode thereof. With reference to the drawings, the invention will now be described in detail with regard for the best mode and the preferred embodiment.

Figure 3:
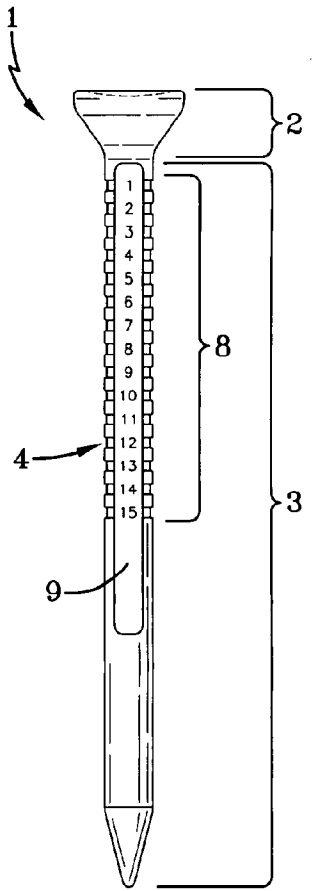
FIG. 3 is an elevation view of the guide side of a golf tee in accordance with one embodiment of the present invention.
Figure 2:
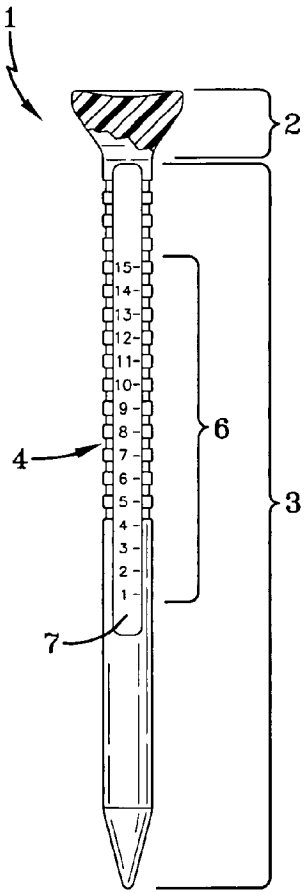
FIG. 2 is an elevation view of a measurement side of a golf tee in accordance with one embodiment of the present invention.
Figure 1:
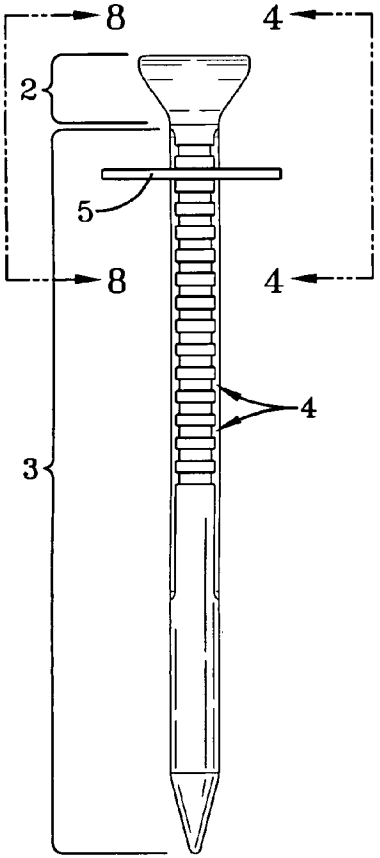
FIG. 1 is an elevation view of a lateral side of a golf tee in accordance with one embodiment of the present invention, with height-setting disk in place.
Figure 8:
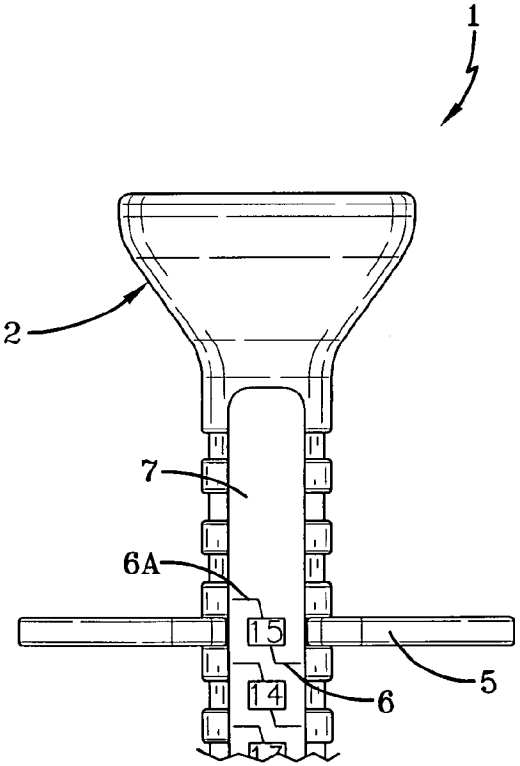
FIG. 8 is a detailed elevation view of the guide side of a golf tee in accordance with another embodiment of the present invention.
Figure 5:
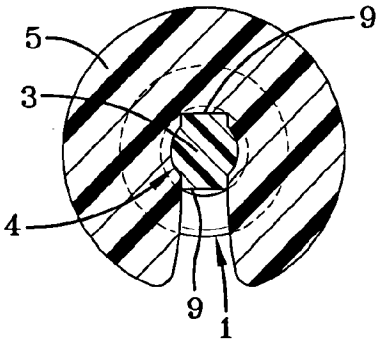
FIG. 5 is a longitudinal view of the golf tee shown in FIG. 1, taken along line A-A, in accordance with one embodiment of the present invention.
Figure 6:
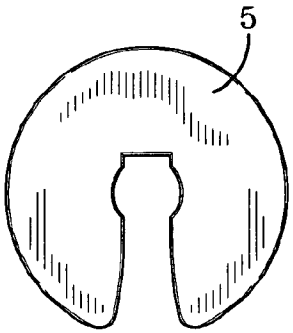
FIG. 6 is a plan view of a height-setting disk used in accordance with one embodiment of the present invention.
Figure 4:
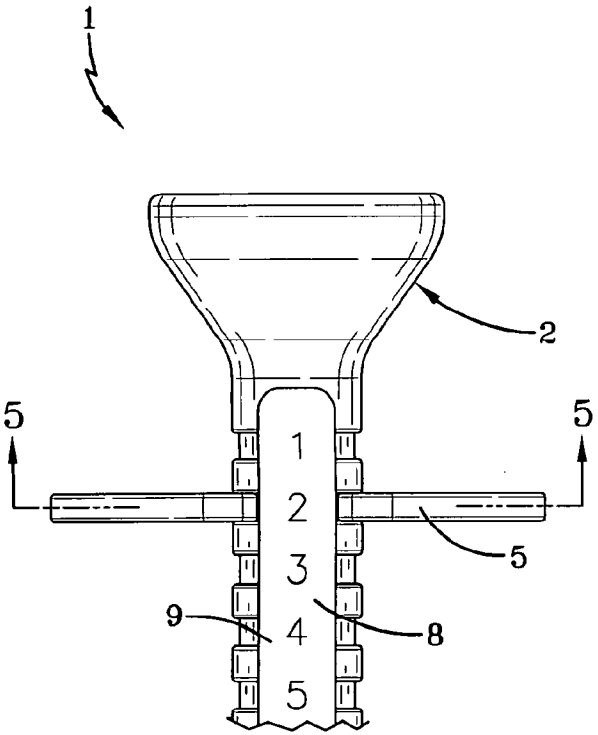
FIG. 4 is detailed elevation view of the guide side of a golf tee in accordance with one embodiment of the present invention.
Figure 7:
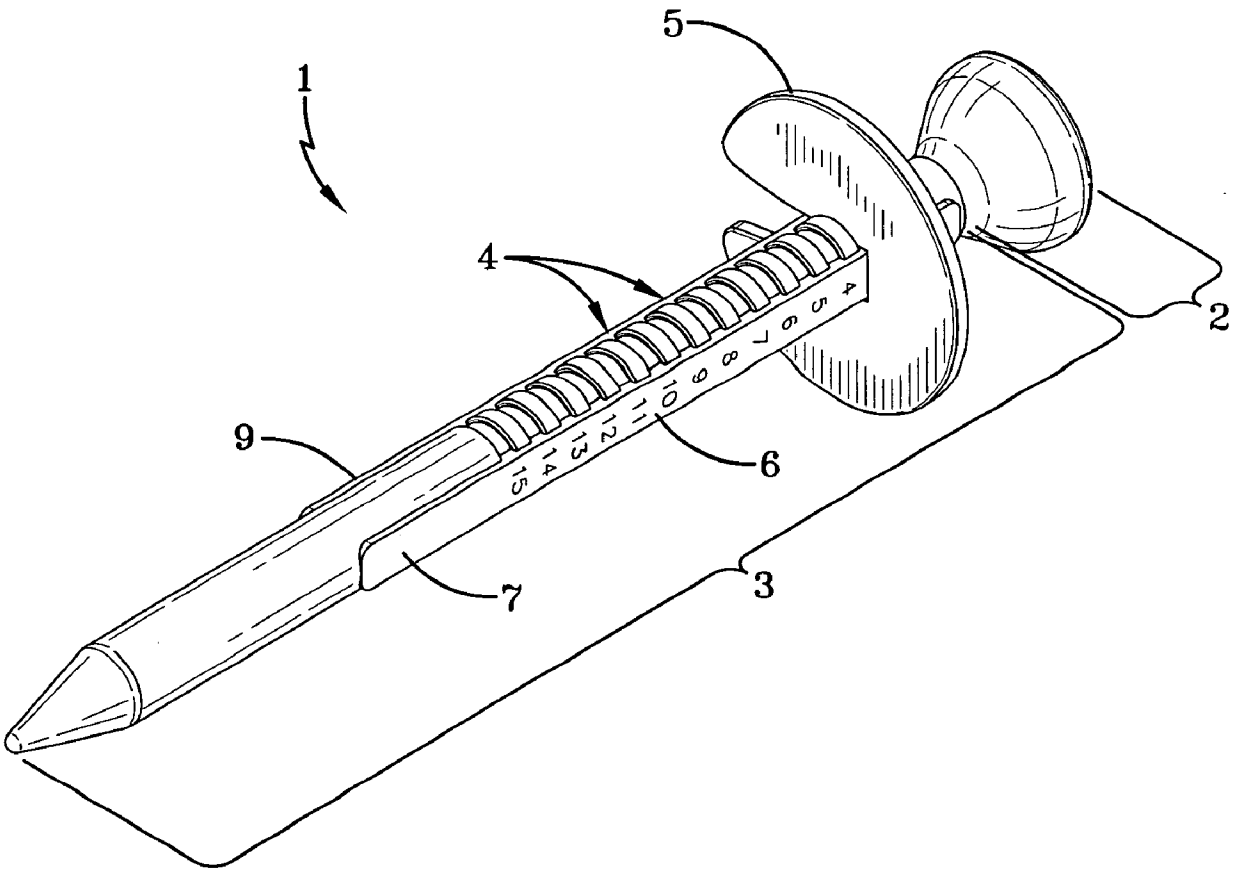
FIG. 7 shows several perspective views of a golf tee in accordance with one embodiment of the present invention, with height-setting disk in place.

An embodiment of the golf tee and golf tee system of the present invention is shown in FIG. 1 (lateral side elevation view), and FIG. 2 (measurement side elevation view; without disk), and FIG. 3 (guide side elevation view; without disk). FIG. 7 shows several perspective views of a golf tee in accordance with one embodiment of the present invention, with height-setting disk in place. All reference numerals refer to corresponding portions of the device throughout the Figures.

The tee of the present invention may be made of any dimensionally stable material, such as wood or preferably high strength plastics. A number of different types of materials may be used for making the present invention. Perhaps the best material is a thermoplastic that can be molded into the desired shape. The shape of the present invention is easily repeatable within a molding process. The present invention could also be constructed of a metal which is either molded, or shaped as by use of a router and lathe. The present invention can also be made of wood. The golf tee of this invention preferably is a single member formed of suitable material such as molded plastic resin, which may be made by any appropriate method, such as injection molding.

The tee includes numerous structural features designed to effectively minimize and control a number of variables that can adversely affect a golfer's skill and enjoyment level. The tee provides a means for obtaining a truly consistent tee height, with respect to the ground into which the tee is inserted, each and every time the ball is teed up. Further, the tee provides a means for obtaining the proper position or alignment of the tee to ensure it is inserted perpendicular (at a true 90 degree angle) to the ground. Lastly, the tee of this invention incorporates features to ensure the stability of the golf tee upon impact with a club, thus minimizing the potential that the tee will either fracture along the spine or "pop" out of the ground and travel haphazardly.

The present invention includes a golf tee adapted to measure the intended position of the ball with respect to the height of the intended impact point upon a golf club face, and provides an insertion height gauge for use in accurately positioning the ball cup of a golf tee, and thus the ball, a desired height above the ground upon insertion of the golf tee into the ground. The golf tee insertion height gauge is preferably constructed integral with the stake portion of the golf tee. The stake portion is adapted to receive an insertion-restricting piece, such as a peg or disk adapted to be fixed onto or into the stake portion, to control the depth to which the stake inserts into the ground.

FIG. 1 shows tee 1 having ball cup portion 2 and stake portion 3. Stake portion 3 is provided with several graduation grooves 4 that define portions that are shaped and adapted to accept and hold an insertion-restricting piece, such as disk 5.

FIG. 2 also shows tee 1 having ball cup portion 2 and stake portion 3. This Figure shows the respective distances of the graduation grooves 4 along the length of the stake portion 3. The stake portion 3 is provided with at least one measurement scale 6 such as that printed along a flattened portion 7 of stake portion 3. This scale may contain any scale indicated by number, letter or symbol scale.

In the displayed embodiment, the numbers 1-15 on the measurement scale, correspond to distances from 9.5 mm (for the numeral 1) as measured from the top of the tee, and proceeding at 2.5 mm increments to 44.5 mm (for the numeral 15), as measured from the top of the tee.

FIG. 3 also shows tee 1 having ball cup portion 2 and stake portion 3. This Figure shows the respective distances of the graduation grooves 4 along the length of the stake portion 3. The stake portion 3 is provided with a guide scale 8 such as that printed along a flattened portion 9 of stake portion 3. This scale may contain any scale indicated by number, letter or symbol scale.

In the displayed embodiment, the numbers 1-15 on the guide scale, correspond to distances from 31.0 mm (for the numeral 1) as measured from the bottom of the tee, and proceeding at 2.5 mm increments to 66.0 mm (for the numeral 15), as measured from the bottom of the tee.

In use, the golf tee is positioned with the point along the bottom of the face of the club intended to be used such that the ball cup end extends toward the top of the club face. This allows the user to determine which of the indicia best represents the distance from the bottom of the club face to the top of the club face. This allows the device to determine the height of the ball's impact (typically and preferably the vertical center of that particular club face where the most effective impact area or "sweet spot" is provided by the club manufacturer).

Once the indicia on the measurement scale 6 corresponding to the desired striking spot is determined, the player or caddie may then find the corresponding indicia on the guide scale 8. The insertion-restricting piece, such as disk 5, is then fixed to the stake portion in the groove corresponding to the corresponding indicia on the guide scale 8. For instance, the player or caddie may determine that the top of the club face lies at the position of numeral "7" on the measurement scale 6. The player or caddie then locates numeral "7" on the guide scale 8 and places insertion-restricting piece, such as disk 5, into the groove located at this position. In the displayed embodiment, this would place one half the ball above the top of the club face upon being teed. Other scale relationships may be developed to place the ball's center at the height of one half the club face height.

It will also be appreciated that the operator may opt for a position either lower or higher than the determined position by simply using the indicia corresponding to a desired different position above or below the top of the club face of the chosen club (for instance, in the given example, selecting to use the numeral "8" on the guide scale to place more than one half the ball above the top of the club face, or selecting the numeral "6" on the guide scale to place less than one half the ball above the top of the club face).

In another embodiment, the golf tee of the present invention may be provided with additional guide scales along the stake portion 3, which indicia are offset from corresponding indicia of the main guide scale 8, such that the operator may choose to use a guide scale that automatically places the ball either a predetermined offset distance from the center as determined by the main measurement scale 8. These additional scales may be color coded or made otherwise visually distinguishable from the main guide scale 8. These additional scales may be placed along the lateral sides of the stake portion 3, shown in FIG. 1.

To use the golf tee of this embodiment of the present invention to adjust it for proper depth to position the ball as desired for striking, the user may hold the tee against the club face of the club to be used such that the point end of the stake portion 3 is aligned with the bottom of the club face and extends along the vertical axis of the club face, such that, as in the case of the displayed embodiment, the numbers on one of the measurement scales may be selected for a relatively centered impact (such as one seen in FIG. 3), or a relatively high or relatively low face impact (which additional scales may be so marked or indicated by color, etc.), are arrayed along that vertical axis. The user then determines which of the numerals on the measurement scale 6 best approximates the top of the club face so as to determine the height of the desired striking position (typically at or near the center of the vertical axis/club face, although other optional positions may be selected and provided for), and places the guide disk 5 in one of the grooves 4 corresponding to the same numeral appearing on the chosen measurement scale selected for a predetermined impact height.

While the foregoing invention has been described with respect to preferred embodiments, it shall be understood that various other changes and modifications to the invention can be made within the spirit and scope of the invention, as claimed.

What is claimed is:

1. A golf tee adapted to allow a person to determine the desired position of a teed golf ball with respect to a desired striking position on the golf club face of a golf club striking the teed golf ball once the tee is placed, said golf tee comprising:

(a) a cup portion;

(b) a stake portion, the stake portion having at least one measurement scale and a guide scale, each scale having respective corresponding indicia, said measurement scale being arranged so as to allow the player to determine said desired striking position on said golf club face, and said guide scale being offset from said measurement scale and having respective corresponding indicia to said measurement scale so as to allow a person to determine the attachment position, along said guide scale at the position of the corresponding indicia on said guide scale, of a removable insertion restriction portion by obtaining a measurement of said club face along said measurement scale; and a plurality of receivers aligned along said stake portion and adapted to releasably attach said removable insertion restriction portion; and (c) a removable insertion restriction portion, adapted to be removable and to be placed on at least two positions along the length of said stake portion.

2. The golf tee according to claim 1 wherein said at least one measurement scale and said guide scale, having respective corresponding indicia in a series, said series of said at least one measurement scale and of said guide scale are positioned so as to allow the user to determine the depth of the insertion of said golf tee required to hold a golf ball thereupon at a predetermined height above the ground, and to guide the placement of said insertion restriction portion along said stake portion so as to prevent said golf tee being inserted beyond said depth.

3. The golf tee according to claim 1, said at least one measurement scale and said guide scale each having respective corresponding indicia in a series, wherein the series of said at least one measurement scale and of said guide scale progress in opposite directions along said stake portion.

4. The golf tee according to claim 1 wherein said stake portion having at least two measurement scales, each measurement scale have corresponding indicia at different positions along said stake portion.

5. The golf tee according to claim 4 wherein said at least two measurement scales are distinguished by identifying indicia or color.

6. A golf tee adapted to allow a person to determine the desired position of a teed golf ball with respect to a desired striking position on the golf club face of a golf club striking the teed golf ball once the tee is placed, and to releasably receive an insertion restriction portion, said golf tee comprising:

(a) a cup portion; and (b) a stake portion, the stake portion having at least one measurement scale and a guide scale, each scale having respective corresponding indicia, said measurement scale, being arranged so as to allow the player to determine said desired striking position on said golf club face, and said guide scale being offset from said measurement scale and having respective corresponding indicia to said measurement scale so as to allow a person to determine the attachment position, along said guide scale at the position of the corresponding indicia on said guide scale, of a removable insertion restriction portion by obtaining a measurement of said club face along said measurement scale; and a plurality of receivers aligned along said stake portion and adapted to releasably attach said removable insertion restriction portion.

7. The golf tee according to claim 6 wherein said at least one measurement scale and said least one guide scale, having respective corresponding indicia in a series, said series of said at least one measurement scale and of said guide scale are positioned so as to allow the user to determine the depth of the insertion of said golf tee required to hold a golf ball thereupon at a predetermined height above the ground, and to guide the placement of said insertion restriction portion along said stake portion so as to prevent said golf tee being inserted beyond said depth.

8. The golf tee according to claim 6, said at least one measurement scale and said guide scale each having respective corresponding indicia in a series, wherein the said series of said at least one measurement scale and of said guide scale progress in opposite directions along said stake portion.

9. The golf tee according to claim 6, wherein said stake portion having at least two measurement scales, each measurement scale have corresponding indicia at different positions along said stake portion.

10. The golf tee according to claim 9 wherein said at least two measurement scales are distinguished by identifying indicia or color.

11. A golf tee adapted to allow a person to determine the desired position of a teed golf ball with respect to a desired striking position on the golf club face of a golf club striking the teed golf ball once the tee is placed, and to releasably receive an insertion restriction portion, said golf tee comprising:

(a) a cup portion; and (b) a stake portion, the stake portion having at least one measurement scale and a guide scale, each scale having respective corresponding indicia, each scale being offset from one another, said scales increasing in magnitude in opposite directions along said stake portion, so as to allow a person to determine the attachment position, along said guide scale at the position of the corresponding indicia on the guide scale, of a removable insertion restriction portion by obtaining a measurement of said club face along said measurement scale; and a plurality of receivers aligned along said stake portion and adapted to releasably attach said removable insertion restriction portion.

* * * * *